US008644519B2

(12) United States Patent
Pance et al.

(10) Patent No.: US 8,644,519 B2
(45) Date of Patent: Feb. 4, 2014

(54) ELECTRONIC DEVICES WITH IMPROVED AUDIO

(75) Inventors: Aleksandar Pance, Saratoga, CA (US); Paul Gerard Puskarich, Palo Alto, CA (US); Craig Leong, San Jose, CA (US); Ronald Nadim Isaac, San Jose, CA (US); Ruchi Goel, San Jose, CA (US); Jim Lynn Tenneboe, Scotts Valley, CA (US); Daniel Culbert, Los Gatos, CA (US); Niel Warren, Soquel, CA (US); Nathan Alan Johanningsmeier, San Jose, CA (US)

(73) Assignee: Apple Inc., Cupertino, CA (US)

( * ) Notice: Subject to any disclaimer, the term of this patent is extended or adjusted under 35 U.S.C. 154(b) by 346 days.

(21) Appl. No.: 12/895,526

(22) Filed: Sep. 30, 2010

(65) Prior Publication Data

US 2012/0082317 A1 Apr. 5, 2012

(51) Int. Cl.
*H04R 1/02* (2006.01)
*H04R 29/00* (2006.01)

(52) U.S. Cl.
USPC ..... 381/59; 381/386

(58) Field of Classification Search
USPC ..... 381/59, 386, 98, 101–103, 305, 306, 381/337, 388, 395; 700/94
See application file for complete search history.

(56) References Cited

U.S. PATENT DOCUMENTS

| | | | | |
|---|---|---|---|---|
| 4,081,631 | A * | 3/1978 | Feder | 200/5 A |
| 4,658,425 | A | 4/1987 | Julstrom | |
| 5,335,011 | A | 8/1994 | Addeo et al. | |
| 5,570,324 | A | 10/1996 | Geil | |
| 5,619,583 | A | 4/1997 | Page et al. | |
| 5,649,020 | A * | 7/1997 | McClurg et al. | 381/151 |
| 6,073,033 | A | 6/2000 | Campo | |
| 6,129,582 | A | 10/2000 | Wilhite et al. | |
| 6,151,401 | A | 11/2000 | Annaratone | |
| 6,154,551 | A | 11/2000 | Frenkel | |
| 6,192,253 | B1 | 2/2001 | Charlier et al. | |
| 6,278,787 | B1 * | 8/2001 | Azima | 381/152 |
| 6,317,237 | B1 | 11/2001 | Nakao et al. | |
| 6,324,294 | B1 * | 11/2001 | Azima et al. | 381/381 |
| 6,332,029 | B1 * | 12/2001 | Azima et al. | 381/152 |

(Continued)

FOREIGN PATENT DOCUMENTS

| | | |
|---|---|---|
| EP | 2094032 | 8/2009 |
| GB | 2310559 | 8/1997 |

(Continued)

OTHER PUBLICATIONS

Baechtle et al., "Adjustable Audio Indicator," IBM, 2 pages, Jul. 1, 1984.

(Continued)

*Primary Examiner* — Vivian Chin
*Assistant Examiner* — Leonard M Giannone
(74) *Attorney, Agent, or Firm* — Blakely, Sokoloff, Taylor & Zafman LLP

(57) ABSTRACT

An electronic device having an enclosure including an upper panel and a bottom panel operably connected to the upper panel. A transducer is operably connected to the enclosure and the transducer is configured to mechanically vibrate the enclosure. The transducer includes an electromagnet, a magnet in communication with the electromagnet and a bracket substantially surrounding the electromagnet and the magnet, the bracket substantially secures the transducer to the bottom panel.

18 Claims, 9 Drawing Sheets

(56) References Cited

U.S. PATENT DOCUMENTS

| | | | | |
|---|---|---|---|---|
| 6,342,831 | B1 * | 1/2002 | Azima | 340/384.1 |
| 6,618,487 | B1 * | 9/2003 | Azima et al. | 381/152 |
| 6,813,218 | B1 | 11/2004 | Antonelli et al. | |
| 6,829,018 | B2 | 12/2004 | Lin et al. | |
| 6,882,335 | B2 | 4/2005 | Saarinen | |
| 6,934,394 | B1 | 8/2005 | Anderson | |
| 7,003,099 | B1 | 2/2006 | Zhang et al. | |
| 7,082,322 | B2 | 7/2006 | Harano | |
| 7,154,526 | B2 | 12/2006 | Foote et al. | |
| 7,158,647 | B2 | 1/2007 | Azima et al. | |
| 7,263,373 | B2 | 8/2007 | Mattisson | |
| 7,266,189 | B1 | 9/2007 | Day | |
| 7,378,963 | B1 | 5/2008 | Begault et al. | |
| 7,536,029 | B2 | 5/2009 | Choi et al. | |
| 2001/0017924 | A1 * | 8/2001 | Azima et al. | 381/165 |
| 2001/0026625 | A1 * | 10/2001 | Azima et al. | 381/152 |
| 2002/0012442 | A1 * | 1/2002 | Azima et al. | 381/431 |
| 2002/0037089 | A1 | 3/2002 | Usuki et al. | |
| 2002/0044668 | A1 * | 4/2002 | Azima | 381/152 |
| 2002/0150219 | A1 * | 10/2002 | Jorgenson et al. | 379/73 |
| 2003/0048911 | A1 * | 3/2003 | Furst et al. | 381/96 |
| 2003/0053643 | A1 * | 3/2003 | Bank et al. | 381/152 |
| 2003/0161493 | A1 * | 8/2003 | Hosler | 381/353 |
| 2004/0156527 | A1 | 8/2004 | Stiles et al. | |
| 2004/0203520 | A1 | 10/2004 | Schirtzinger et al. | |
| 2005/0129267 | A1 * | 6/2005 | Azima et al. | 381/431 |
| 2005/0147273 | A1 | 7/2005 | Azima et al. | |
| 2005/0271216 | A1 * | 12/2005 | Lashkari | 381/59 |
| 2006/0005156 | A1 * | 1/2006 | Korpipaa et al. | 717/100 |
| 2006/0023898 | A1 * | 2/2006 | Katz | 381/98 |
| 2006/0072248 | A1 | 4/2006 | Watanabe et al. | |
| 2008/0204379 | A1 * | 8/2008 | Perez-Noguera | 345/80 |
| 2008/0292112 | A1 | 11/2008 | Valenzuela et al. | |
| 2009/0247237 | A1 | 10/2009 | Mittleman et al. | |
| 2009/0274315 | A1 | 11/2009 | Carnes et al. | |
| 2009/0316943 | A1 | 12/2009 | Munoz et al. | |
| 2010/0103776 | A1 | 4/2010 | Chan | |
| 2011/0002487 | A1 | 1/2011 | Panther et al. | |
| 2011/0033064 | A1 | 2/2011 | Johnson et al. | |
| 2011/0161074 | A1 | 6/2011 | Pance et al. | |
| 2011/0243369 | A1 | 10/2011 | Wang | |
| 2011/0274303 | A1 | 11/2011 | Filson et al. | |
| 2012/0082317 | A1 | 4/2012 | Pance et al. | |

FOREIGN PATENT DOCUMENTS

| | | | |
|---|---|---|---|
| GB | 2342802 | | 4/2000 |
| JP | 2102905 | | 4/1990 |
| WO | WO03/049494 | | 6/2003 |
| WO | WO2004/025938 | | 3/2004 |
| WO | WO 2007045908 | A1 * | 4/2007 |
| WO | WO2008/153639 | | 12/2008 |
| WO | WO2009/017280 | | 2/2009 |
| WO | WO2011/057346 | | 5/2011 |

OTHER PUBLICATIONS

Pingali et al., "Audio-Visual Tracking for Natural Interactivity," Bell Laboratories, Lucent Technologies, pp. 373-382, Oct. 1999.

International Search Report and Written Opinion, PCT/US2011/052589, 13 pages, Feb. 25, 2012.

Final Office Action (dated Aug. 2, 2013), U.S. Appl. No. 13/076,819, filed Mar. 31, 2011, First Named Inventor: Aleksandar Pance, (11 pages).

Non-Final Office Action (dated Mar. 25, 2013), U.S. Appl. No. 13/076,819, filed Mar. 31, 2011, First Named Inventor: Aleksandar Pance, (13 pages).

PCT International Preliminary Report on Patentability (dated Apr. 11, 2013), International Application No. PCT/US2011/052589, International Filing Date—Sep. 21, 2011, (9 pages).

* cited by examiner

ELECTRONIC DEVICES WITH IMPROVED AUDIO

BACKGROUND

I. Technical Field

Embodiments disclosed herein relate generally to electronic devices, and more specifically to audio speakers for electronic devices.

II. Background Discussion

Many electronic devices, such as computers, smart phones, and the like are becoming smaller and more compact. As these electronic devices become smaller the internal space available for audio speakers becomes smaller as well. This is especially true as space within the device enclosure for audio speakers may compete with the space required for circuit boards, hard drives, and the like. Generally, as a speaker decreases in size it is able to move less mass and thus sound quality (or at least loudness) may decrease. This may be especially noticeable for sounds in the lower end of the audio spectrum, e.g., beneath 1 kHz. Furthermore, the available volume within an electronic device shrinks, which in turn provides less air for a speaker to vibrate and thus limits the audible response. Similarly, the volume level and frequencies able to be produced by a speaker may also decrease as the size of the speaker decreases. Thus, as electronic devices continue to decrease in size, detrimental effects may be experienced for audio produced by the devices.

SUMMARY

Embodiments of the disclosure may include a electronic device including a processor, memory in electrical communication with the processor, an audio transducer in electrical communication with the processor and an enclosure. The audio transducer includes a magnetic coil, and a magnet in communication with the magnetic coil. The enclosure includes a top panel, a bottom panel and the enclosure substantially surrounds the processor, the memory, and the audio transducer. The audio transducer is operably connected to the at least one of the top panel or the bottom panel of the enclosure.

Another embodiment of the disclosure takes the form of an electronic device having a processor, an enclosure including an upper panel and a bottom panel operably connected to the upper panel, a transducer operably connected to the enclosure and electrically connected to the processor, wherein the transducer is configured to output a vibration that vibrates the enclosure, thereby producing an audio signal, and a first speaker electrically connected to the processor and operative to output a speaker audio signal, wherein the speaker audio signal and audio signal cooperate to produce a sound. The audio transducer may include an electromagnet, a magnet in communication with the electromagnet, and a bracket substantially surrounding the electromagnet and the magnet, wherein the bracket substantially secures the transducer to the bottom panel.

Still another embodiment may take the form of a method for outputting a sound from an electronic device, including the operations of: by a processor of the electronic device, determining a first and second audible portion of the sound; electrically driving an audio transducer within an enclosure of the electronic device to produce a vibration; through the vibration, moving the enclosure to produce the first audible portion of the sound; and electrically driving a speaker within the enclosure to move an air mass, thereby producing the second audible portion of the sound.

DETAILED DESCRIPTION

Embodiments of the disclosure are directed towards an audio system for electronic devices. Sample audio systems may include an audio transducer, such as a surface transducer that may be partially enclosed within, and mechanically mated to an interior of, the electronic device enclosure. The combination of the magnet and electromagnet generally mechanically move the enclosure and/or vibrate a supporting surface.

The audio transducer may also include, or be adjacent, a transmission material that may serve to increase the energy transmitted between the audio transducer and the enclosure. In some embodiments the transmission material is gel or a gel-like substance.

The audio transducer may include a magnet and corresponding coil or electromagnet. The audio transducer typically is electrically connected to a processor, memory, hard drive or the like. The audio transducer receives electrical signals and produces sound waves in response. The varying electrical signals alternatively cause the coil to repel and attract the magnet, causing the magnet or the coil to move depending on the embodiment of the audio transducer. In some embodiments, the magnet remains fixed (e.g., stationary) and in other embodiments the coil is fixed. The movement of the audio transducer causes the enclosure to vibrate, thereby producing sound waves outside the enclosure. (Should the transducer be mounted to a surface other than the interior of the enclosure, this other surface may vibrate in addition to or in lieu of the enclosure). This mechanical movement may cause certain portions of or all of the electronic device to vibrate. The enclosure thus may act as a diaphragm to produce audible sound. Furthermore, the audio transducer may cause a surface on which the electronic device rests to move and/or vibrate as well. This additional moving surface may act to increase the audio volume, as well as potentially enhancing the listening experience of the user.

Additionally, in some embodiments the electronic device may include one or more feet configured to match the audio impedance of the audio transducer. In these embodiments, the feet may transfer additional motion/audio energy to the surface, thereby further increasing the volume of the sound produced by the audio transducer (as more mass is moved). Furthermore, as the audio transducer may not require a grille, screen or other opening in the enclosure in order for the sounds produced to be audible, in some embodiments the electronic device may be completely sealed. This may allow the electronic device to be air- and/or water-tight and have a more refined overall appearance.

Figure 1A:
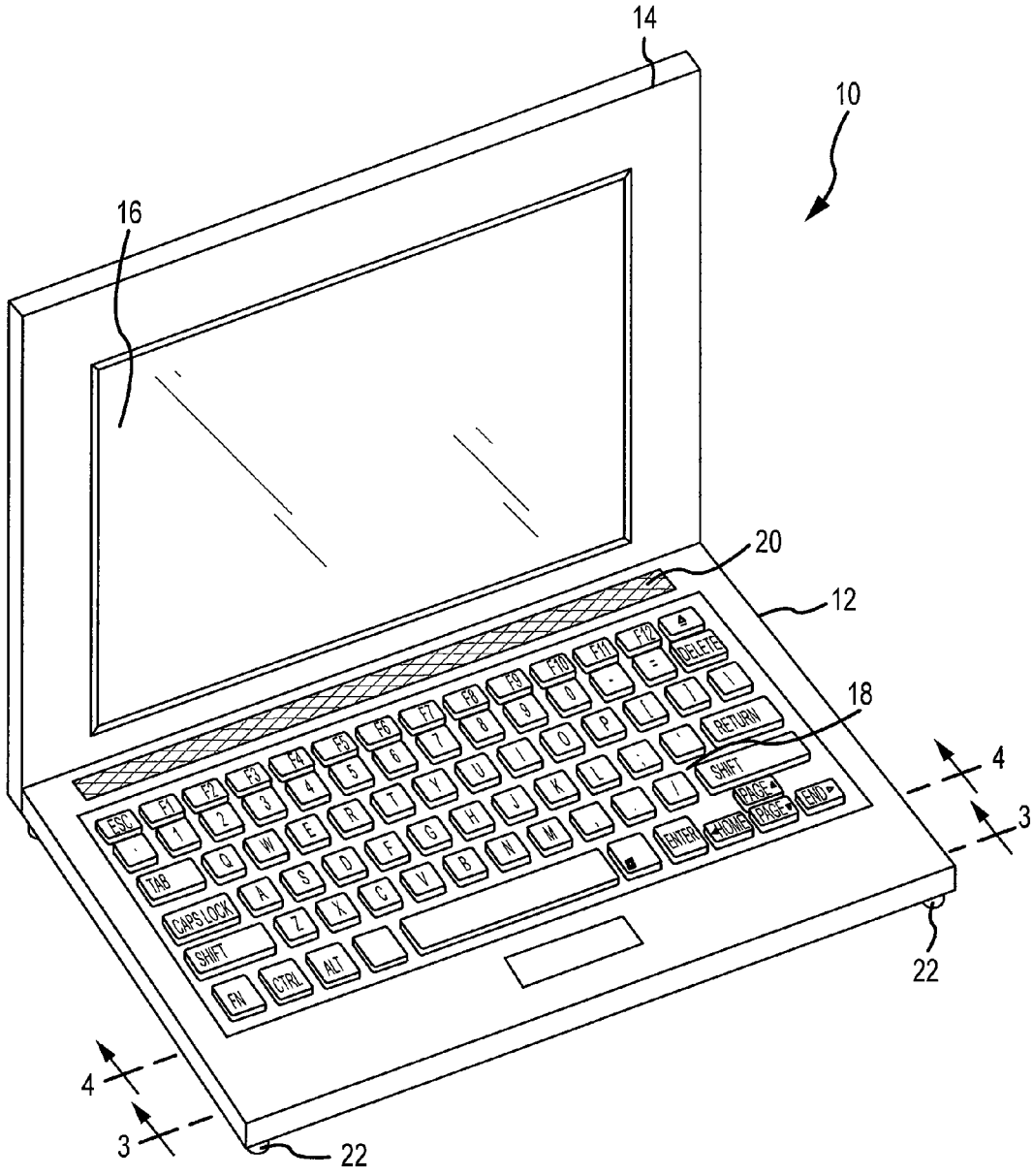
FIG. 1A is a perspective view of a sample electronic device.
Figure 1B:
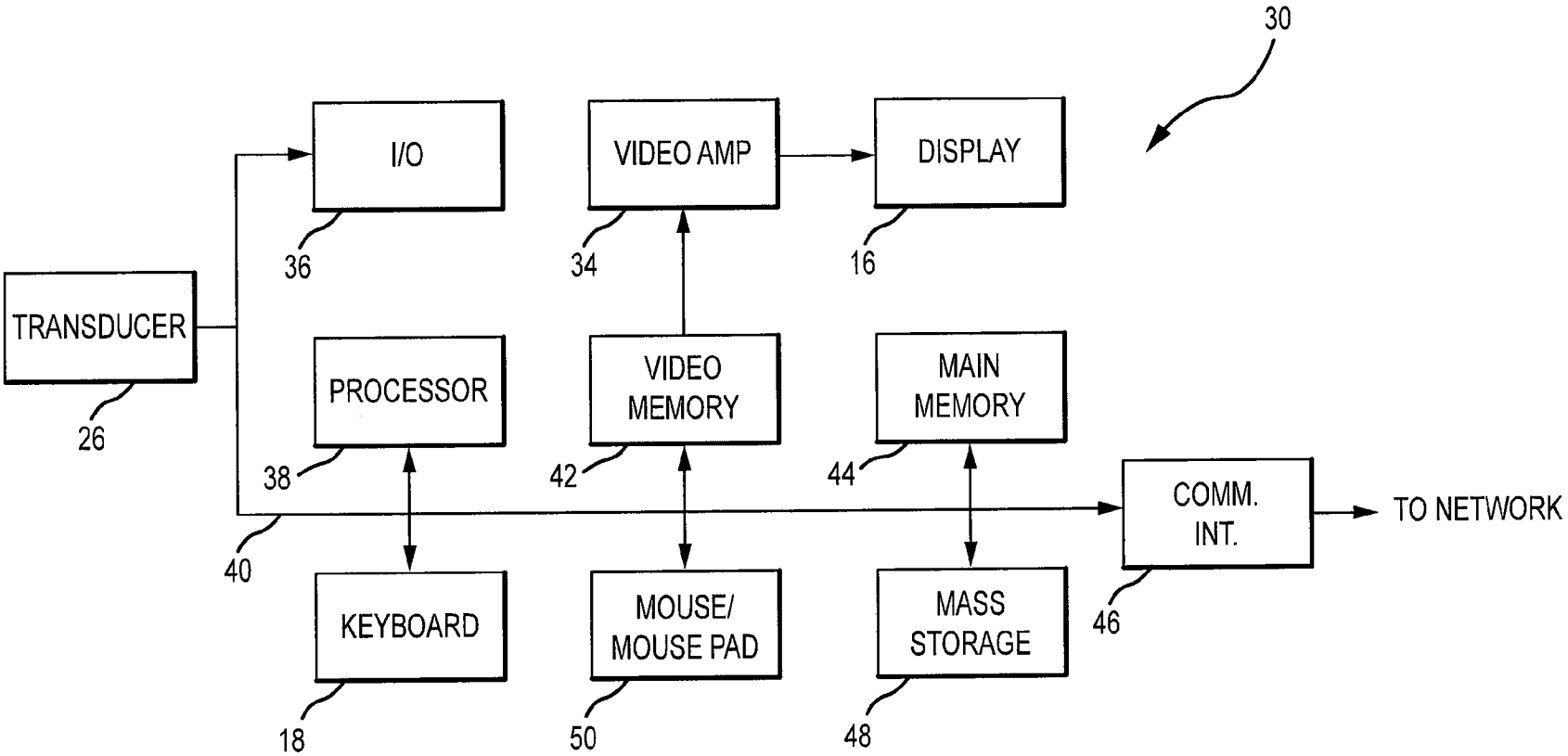
FIG. 1B is a block diagram of certain elements of the electronic device illustrated in FIG. 1A.
Figure 2:
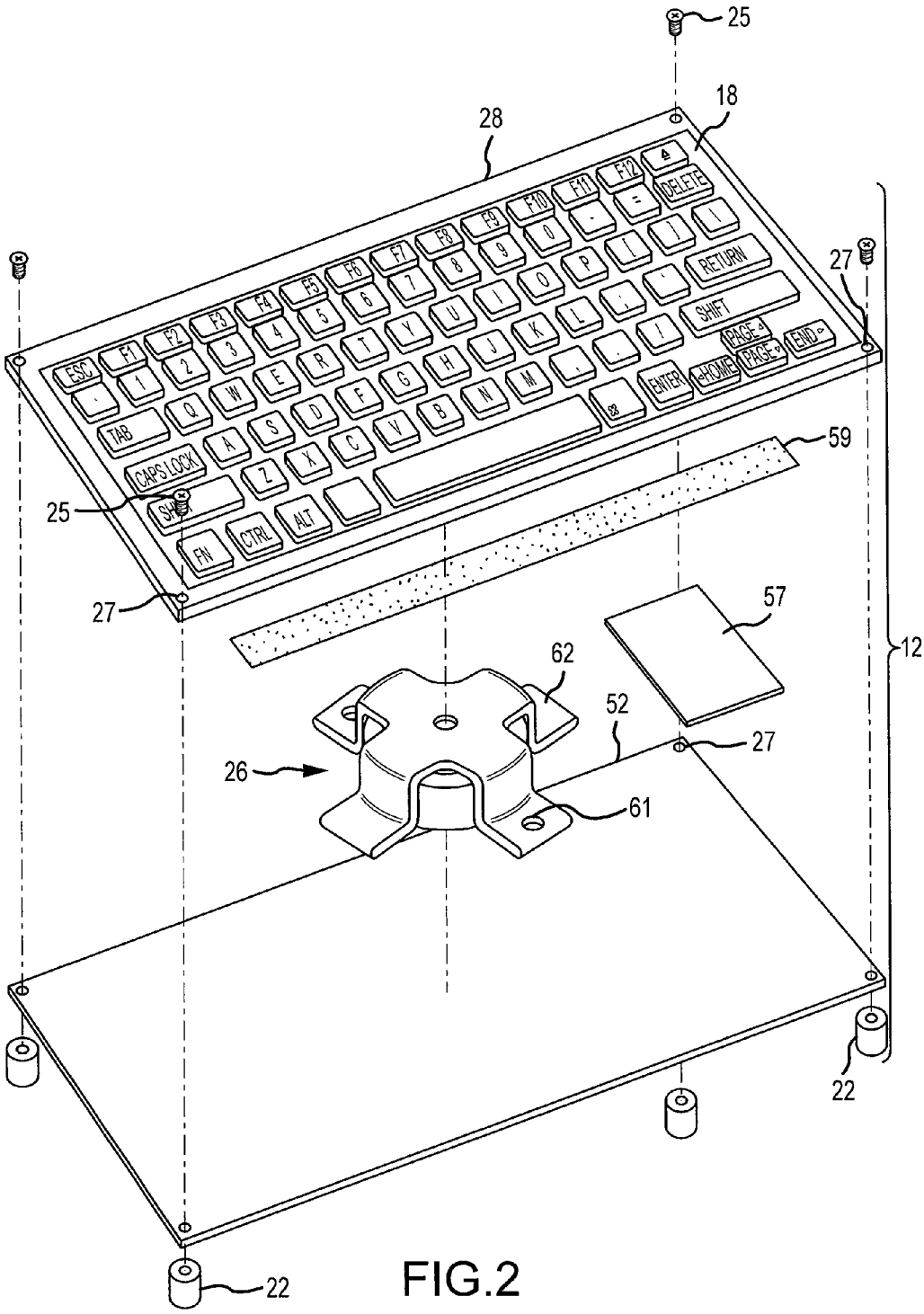
FIG. 2 is an exploded view of a bottom enclosure of the electronic device, showing an audio transducer and circuit boards.

FIG. 1A illustrates a perspective view of a electronic device 10; FIG. 1B illustrates a block diagram of one embodiment of the electronic device 10. The electronic device 10 may include a top enclosure 14 and a bottom enclosure 12. The enclosures 12, 14 generally surround or enclose the internal components of the electronic device 10, although apertures and the like may be formed into one or both of the enclosures. The electronic device 10 may include a keyboard 18, a display screen 16, a speaker 20, and feet 22. Also, the electronic device 10 generally includes an audio transducer 26 (as shown in FIG. 2) encased within or affixed to one or both of the enclosures 12, 14.

The electronic device 10 is capable or storing and/or processing signals such as those used to produce images and/or sound. In some embodiments, the electronic device 10 may be a laptop computer, a handheld electronic device, a mobile telephone, a tablet electronic device, an audio playback device, such as an MP3 player, and the like. A keyboard 18 and mouse (or touch pad) 50 may be coupled to the computer device 10 via a system bus 40. Additionally, in some embodiments, the keyboard 18 and the mouse 50 may be integrated into one of the enclosures 12, 14 as shown in FIG. 1A. In other embodiments the keyboard 18 and/or mouse 50 may be external to the electronic device 10.

Figure 6:
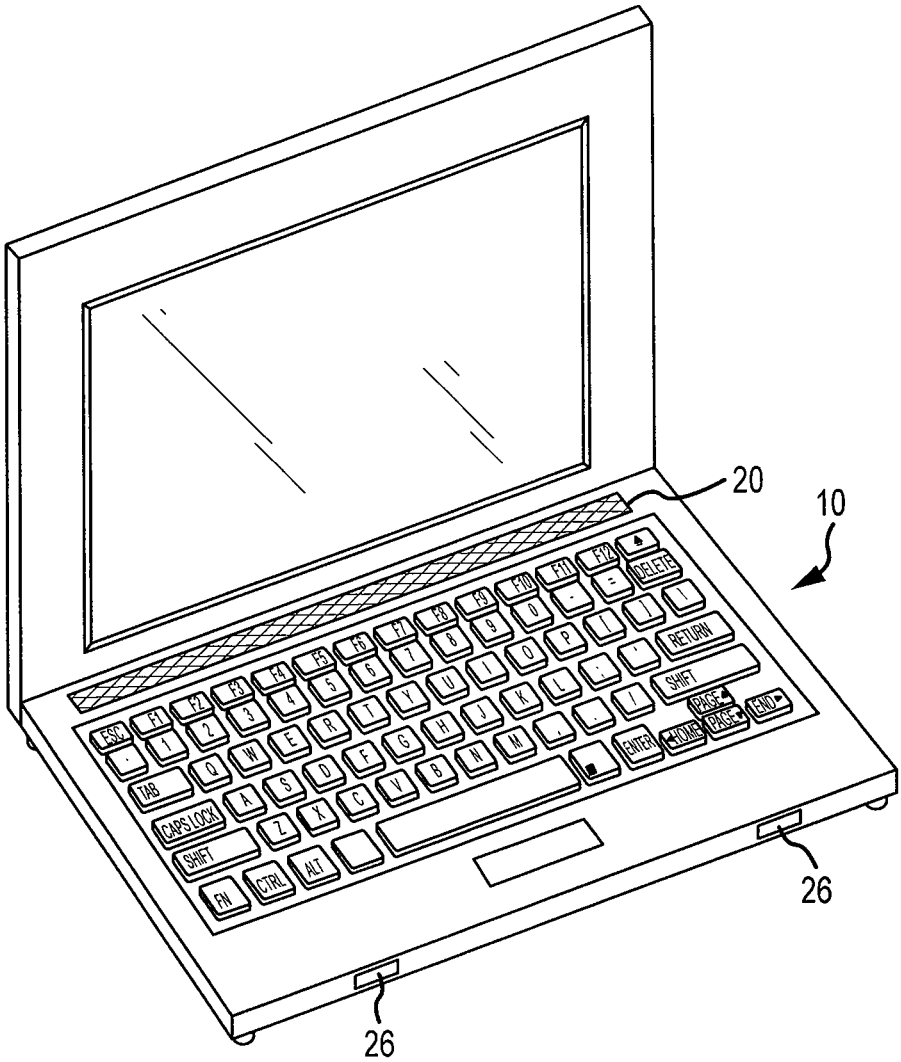
FIG. 6 is a perspective view of the electronic device of FIG. 1 in a stereo audio configuration.

The keyboard 18 and the mouse 50, in one example, may provide user input to the computer device 10; this user input may be communicated to a processor 38 through suitable communications interfaces, buses and the like. Other suitable input devices may be used in addition to, or in place of, the mouse 50 and the keyboard 18. For example, in some embodiments the electronic device 10 may be a smart phone, tablet computer or the like and include a touch screen (e.g. a capacitive screen) in addition to or in replace of either the keyboard 18, the mouse 50 or both. An input/output unit 36 (I/O) coupled to the system bus 40 represents such I/O elements as a printer, stylus, audio/video (NV) I/O, and so on. For example, as shown in FIG. 6 external speakers may be electrically coupled to the electronic device 10 via an input/outlet connection (not shown).

The electronic device 10 also may include a video memory 42, a main memory 44 and a mass storage 48, all coupled to the system bus 40 along with the keyboard 18, the mouse 50 and the processor 38. The mass storage 48 may include both fixed and removable media, such as magnetic, optical or magnetic optical storage systems and any other available mass storage technology. The bus 40 may contain, for example, address lines for addressing the video memory 42 or the main memory 44.

The system bus 40 also may include a data bus for transferring data between and among the components, such as the processor 38, the main memory 44, the video memory 42 and the mass storage 48. The video memory 42 may be, for example, a dual-ported video random access memory or any other suitable memory. One port of the video memory 42, in one example, is coupled to a video amplifier 34 which is used to drive a display 16. The display 16 may be any type of screen suitable for displaying graphic images, such as a liquid crystal display, cathode ray tube monitor, flat panel, plasma, or any other suitable data presentation device. Furthermore, in some embodiments the display 16 may include touch screen features, for example, the display 16 may be capacitive. These embodiments allow a user to enter input into the display 16 directly.

The electronic device 10 includes a processor 38, which may be any suitable microprocessor or microcomputer. The electronic device 10 also may include a communication interface 46 coupled to the bus 40. The communication interface 46 provides a two-way data communication coupling via a network link. For example, the communication interface 46 may be a satellite link, a local area network (LAN) card, a cable modem, and/or wireless interface. In any such implementation, the communication interface 46 sends and receives electrical, electromagnetic or optical signals that carry digital data streams representing various types of information.

Code and/or other information received by the electronic device 10 may be executed by the processor 38 as the code is received. Code may likewise be stored in the mass storage 48, or other non-volatile storage for later execution. In this manner, the electronic device 10 may obtain program code in a variety of forms and from a variety of sources. Program code may be embodied in any form of computer program product such as a medium configured to store or transport computer readable code or data, or in which computer readable code or data may be embedded. Examples of computer program products include CD-ROM discs, ROM cards, floppy disks, magnetic tapes, computer hard drives, servers on a network, and solid state memory devices.

The electronic device 10 may also include an audio transducer 26. The audio transducer 26 may be coupled to the system bus 40, which may in turn electrically connect the audio transducer 26 to any of the processor 38, main memory 44, mass storage 48 and the like. The audio transducer 26 is an output device that produces sound waves in response to electrical signals. The audio transducer 26 may be encased within or otherwise affixed to one of the enclosures 12, 14 and may be used alone or in combination with other output devices (such as the speaker 20) to produce sound. Additionally, the audio transducer 26 may mechanically vibrate other surfaces, such as the enclosures 12, 14 and/or a supporting surface on which the device rests, to produce a louder sound. Thus, as the audio transducer 26 responds to the electrical signal it vibrates the enclosure 12, 14 and/or a supporting surface 24, which in turn disturbs air particles and produces sound waves.

Figure 3:
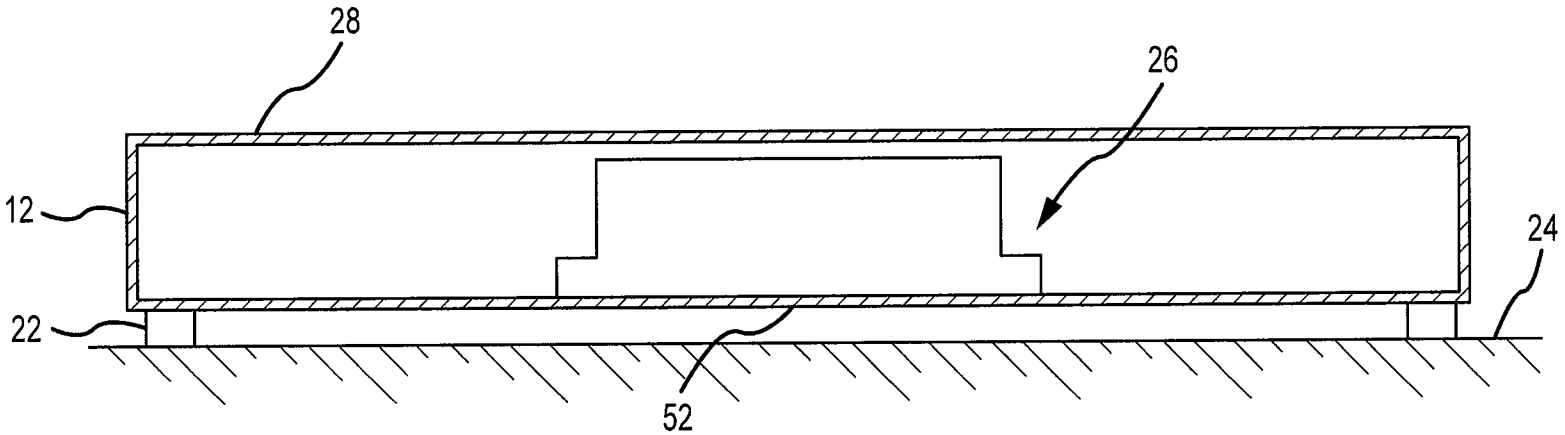
FIG. 3 is a simplified cross-sectional view of the electronic device showing the audio transducer, taken along line 3-3 of FIG. 1A.
Figure 4:
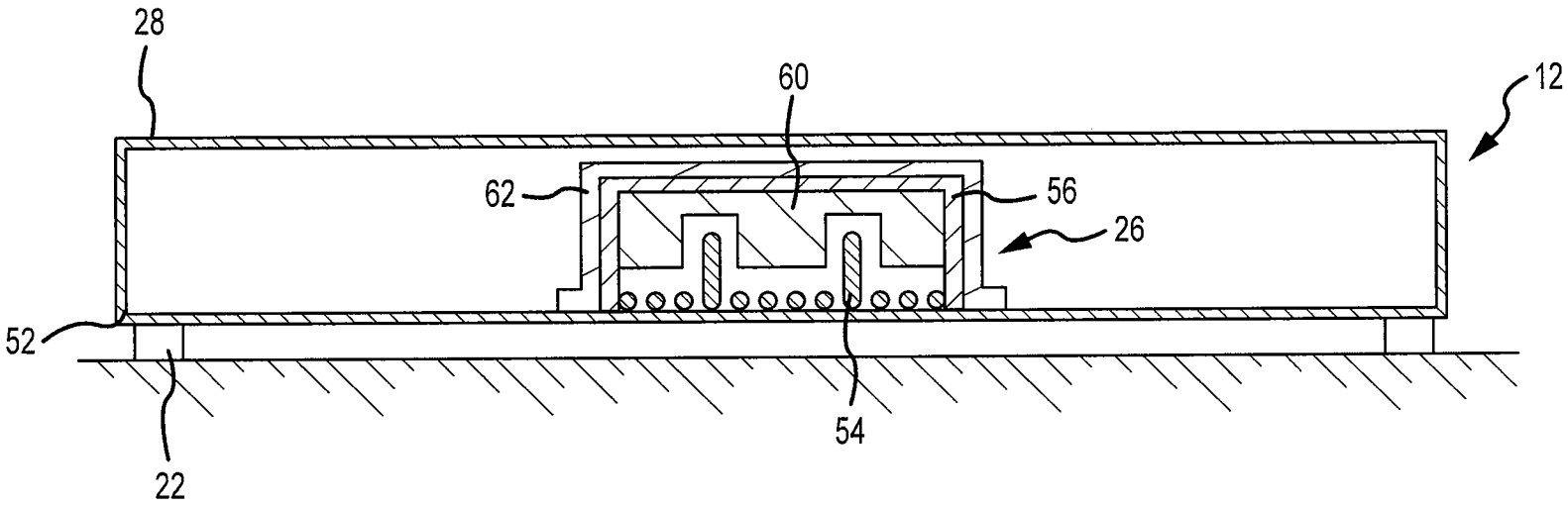
FIG. 4 is a simplified cross-sectional view of the electronic device and showing an embodiment of the audio transducer, taken along line 4-4 in FIG. 1A.

FIGS. 2-4 will now be described and embodiments discussed with respect thereto. FIG. 2 illustrates an exploded view of the bottom enclosure 12, showing certain elements of the aforementioned computer device (although some are omitted for clarity). FIG. 3 illustrates a simplified cross-sectional view of an embodiment of the audio transducer 26 installed within the bottom enclosure 12, viewed along line 3-3 of FIG. 1A. (The audio transducer is shown as a block for simplicity.) FIG. 4 illustrates a simplified cross-sectional view of another embodiment of the audio transducer, also taken along line 3-3 of FIG. 1A. With respect to both FIGS. 3 and 4, it should be appreciated that internal components of the electronic device 10, other than the audio transducer, are omitted for clarity. It should be noted that the audio transducer 26 may be installed in the upper enclosure 14. In certain embodiments, the lower enclosure 12 may include an upper panel 28 and a bottom panel 52. The upper panel 28 may form the top surface of the device 10 and, in some embodiments, surround the keyboard 18, track pad 50, touch screen (not shown) or other input device, and the like. The bottom panel 52 may form the bottom surface of the electronic device 10. Typically, the upper panel 28 forms the top surface of the enclosure and may provide access to the keyboard 18 and/or mouse 50. In tablet-style devices, there may be a single enclosure defined by the top and bottom panels.

The enclosures 12, 14 may be constructed out of a variety of materials and, depending on the type electronic device 10, may be constructed in a variety of different shapes. In some embodiments, the enclosures 12, 14 may be constructed out of carbon fiber, aluminum, glass and other similar, relatively stiff materials. The material for the enclosures 12, 14 in some embodiments may improve the sound volume and/or quality produced by the audio transducer 26. This is because in some embodiments the enclosure 12, 14 mechanically vibrates due to vibrations produced by the audio transducer 26, producing sound waves. Thus, the material may be altered to be more responsive to the vibrations and/or more easily move, increasing the sound quality/volume. Additionally, it should be noted that the bottom enclosure 12 and the top enclosure 14 may be constructed out of different materials from each other. Furthermore, in some embodiments the electronic device 10 may only include one of the enclosures 12, 14. For instance, if the electronic device 10 display 16 includes a touch screen or other display device that also accepts input, then the bottom enclosure 12 may be omitted as the keyboard 18 and mouse 50 may be integrated into the top enclosure 14.

The enclosures 12, 14 in some embodiments may be water and/or air-tight. This is because the audio transducer 26, as discussed in more detail below, may not require an air-opening (e.g., a grille or screen) in order for a user to hear sound waves produced by the audio transducer 26. The audio transducer 26 uses the enclosures 12, 14 and/or supporting surface to produce sound waves, as opposed to a diaphragm within a traditional speaker that must be open to the air in order for the sound waves to be heard. Therefore, the enclosures 12, 14 and thus the electronic device 10 may be completely sealed from water and/or air. This may permit the electronic device 10 to be waterproof, more versatile, and allows the electronic device 10 to have a refined, smooth outer appearance. However, as the electronic device 10, may include a combination of a audio transducer 26 and a speaker 20, in other embodiments the enclosures 12, 14 may include a grill/screen (see e.g. FIGS. 5-7).

The bottom panel 52 and the upper panel 28 may be connected together in a variety of ways. In the embodiment illustrated in FIG. 2, the upper panel 28 and the bottom panel 52 are attached via fasteners 25. The fasteners 25 may be inserted in apertures 27 on both panels 28, 52. Additionally, in some embodiments the fasteners 25 may be used to attach the feet 22 to the bottom panel 52. The top enclosure 14 may be similarly secured to together, including an upper and bottom panel (not shown). In other embodiments, the enclosures 12, 14 may be glued together or otherwise secured. In still other embodiments, the upper panel 28 and the bottom panel 58 may include a seal disposed between to create a waterproof, air tight connection. The seal helps prevent elements from entering into the inner cavity of the enclosure 12, 14 when the panels 28, 52 are secured together.

The internal elements described above with regard to FIG. 1B are represented by the circuit boards 57, 59, which are shown in a representative fashion only. More or fewer circuit boards or other circuitry may be present and the shape of the boards/circuitry may vary from what is shown. The circuit boards 57, 59 may include a combination of the elements described above with respect to FIG. 1B, such as main memory 44, video memory 42, mass storage 48, the processor 38 and the like. The circuit boards 57, 59 may be electrically connected to the audio transducer 26 via the system bus 40 or another electrical connection. Furthermore, the circuit boards 57, 59 may be secured to the enclosures 12, 14 and enclosed inside.

The audio transducer 26 may be installed in such a manner that it is affixed to either the upper panel 28 or the bottom panel 52. In some instances, the audio transducer 26 may be operably connected to the upper panel 28 and the bottom panel 52, but in other embodiments the audio transducer 26 may be operably connected to only one of the panels 28, 52. In still other embodiments, the audio transducer 26 may be connected to a circuit board 57, 59, for instance a motherboard, logic board or the like. Thus, in different embodiments the audio transducer 26 may be connected to either of the panels 28, 52 or either of the circuit boards 57, 59.

Figure 5:
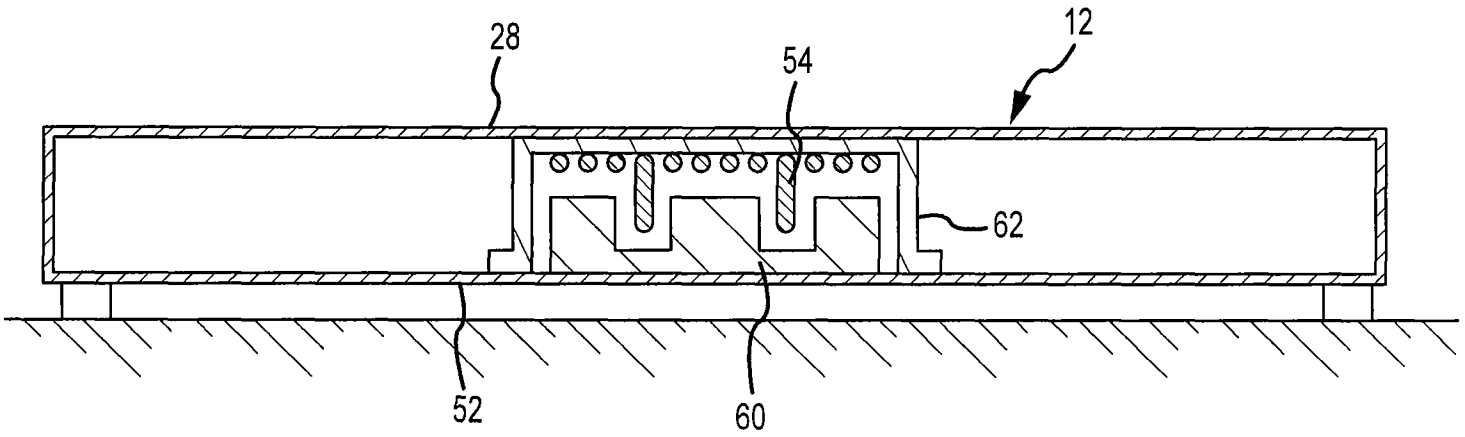
FIG. 5 is a simplified cross-sectional view of another embodiment of the audio transducer within the electronic device, viewed along line 3-3 in FIG. 1A.

FIG. 4 and FIG. 5 illustrate alternative embodiments of the audio transducer 26. In either embodiment, the audio transducer 26 may be a gel speaker, a surface transducer or other device that produces sound by vibrating a surface. In operation, the audio transducer 26 typically receives electrical signals from the processor 38 and translates those electrical signals into vibrations, which in turn may be perceived as audible sound. The audio transducer 26 may include a bracket 62, a transmission material 56, a coil 54 and a magnet 60.

With respect to FIG. 2, the bracket 62 secures the audio transducer 26 to the enclosure 12 and specifically to one of or both of the panels 28, 52. The bracket 62 helps to substantially prevent the audio transducer 26 from moving within the enclosure 12 and thus remain in one location even when vibrating. The bracket 62 may be affixed to the enclosure 12 via fastener 61. The fastener 61 may attach the bracket 62 to the bottom panel 52. In other embodiments, the fastener 61 attaches the bracket 62 to the upper panel 28 and/or one or both of the circuit boards 57, 59. However, the bracket 62 may be attached to the enclosure 12 in a variety of manners, and the fastener 61 is only one example. For instance, in some embodiments the audio transducer 26 may be glued, soldered, or the like to either or both of the panels 28, 52 and/or one or both of the circuit boards 57, 59.

Referring now to FIGS. 4 and 5, the transducer 26 includes a coil 54 made of an electrically conductive material. When an electrical signal is transmitted through the coil 54 it acts as an electromagnet. If an alternating current is passed through the coil, the coil may alternate between being magnetically active and inactive, or polarized an non-polarized depending on the nature of the coil. The audio transducer 26 typically also includes a magnet 60 that is biased into a rest position by a spring, plate or the like. The magnet 60 has a set polarization and, depending on the audio signal, either is forced towards the coil 54 or away from the coil 54 when the coil is energized. The magnet 60 may be any type of material with magnetic properties, for example, iron or another ferrous material. Thus, as current is passed through the coil, the magnet is forced away from the coil (or drawn towards the coil, depending on the relative polarization of coil and magnet). Generally, the coil forces the magnet away when energized. When the coil is not energized, the magnet returns to its rest state, which is relatively nearer the coil than the magnet's position when the coil is energized. Further, the distance the magnet travels from the coil may be varied by varying the electrical charge to which the coil is subjected. In this manner, the magnet may be driven by the coil in precise motions depending on the strength and duration of electrical current applied to the coil. These motions may vibrate not only air near the magnet, but also any surface to which the magnet is attached.

In this manner, the audio transducer 26 may induce vibrations in a surface (such as an enclosure of the electronic device) to which the transducer is affixed by the bracket 62. The motion of the surface may produce audible sound waves in much the same manner as the diaphragm of a conventional speaker moves air to produce a similar effect.

The coil 54 may be configured in a variety of implementations and may be attached to a surface that is either fixed or one that is movable. For example, in FIG. 4 the coil 54 is attached to a movable surface (e.g., the bottom panel 52 in this embodiment), and the surface is displaced vertically when the audio transducer receives an electrical signal. By contrast, in FIG. 5 the coil 54 is attached to a relatively immovable surface (e.g. the bracket 62, upper panel 28, circuit boards 57, 59, and the like), which remains fixed in the vertical direction. In such an embodiment, the magnet 60 may move instead of the coil moving as described below in more detail.

In some embodiments, the coil 54 may be integrated into an enclosure 12, 14 or inside a box or other container that is affixed to an enclosure. (For purposes of clarity, such a container is not shown in FIGS. 4-5.) For example, in the embodiment shown in FIG. 5, the coil 54 may be integrated into the upper panel 28, and in the embodiment in shown FIG. 4 the coil 54 may be integrated in to the bottom panel 52. In these embodiments, the thickness of the audio transducer 26 and/or the enclosure 12 may be reduced. For example, the material of the enclosures 12, 14 may include electromagnetic material installed in a location above and/or below the audio transducer 26. In such an embodiment, the electromagnetic material may be close enough to interact with the magnet 60, thereby eliminating the need for a separate coil 54. Thus, the height required by the audio transducer 26 stack may be reduced.

As with the coil 54, depending on the embodiment, the magnet 60 may either be fixed or movable. In the embodiment illustrated in FIG. 4 the magnet 60 is attached to a fixed surface and does not substantially move, whereas in the embodiment of FIG. 5 the magnet 60 is attached to a movable surface and moves towards and away from the coil 54. In embodiments where the magnet does not move, the coil may be forced away from the magnet when energized, thus vibrating the surface to which the coil is attached which, in turn, may create audible sound waves. Accordingly, it should be appreciated that motion of either the magnet or the coil may move an associated enclosure, the entirety of the device 10, a surface on which the device rests, and so on.

The coil 54 may also include projections or posts. These projections may be received within corresponding crevices in the magnet 60. The projections may increase the intensity of the interaction between the magnet 60 and the coil 54. However, in other embodiments the coil 54 and the magnet 60 may be substantially planar with faces adjacent one another.

Referring now to the embodiment of FIG. 4, if the coil 54 is attached to the bottom panel 52 of the enclosure 12 and the magnet 60 is attached to the bracket 62, which is in turn secured to the enclosure 12. In this embodiment, when an electrical signal is sent through the coil 54, the coil 54 becomes magnetized, and may alternate between a polarized and non-polarized state. This alteration causes the coil 54 to create an instantaneous AC magnetic field that interacts with the magnet, thereby either repelling or attracting the magnet 60. The magnet is secured to the enclosure while the coil is free to move; thus, when the magnetic field ceases, the coil may then return to a rest position due to biasing forces, which may be magnetic or physical. Thus, the coil oscillates away from and toward the magnet; the frequency of oscillation and distance traveled by the coils is directly controlled by the timing and magnitude of electric charge applied to the coil. As the coil 54 is operably attached to the bottom panel 52, the bottom panel 52 also moves and/or vibrates with the movement of the coil 54. The larger the coil motion, the greater the motion of the bottom panel. Likewise, the faster the coil motion, the faster the motion of the bottom panel. Thus, the distance and frequency of the panel's motion may likewise be controlled by varying the timing and magnitude of electric current applied to the coil. By changing the frequency of motion, different sounds may be produced. By changing the displacement of the panel, louder or softer noises may be created. The coil and magnet may be in separate housings to permit them to move relative to one another.

In a similar fashion, the embodiment of FIG. 5 shows the coil in a fixed position and the magnet 60 attached to the bottom panel 52. Thus, the magnet vibrates as the coil is alternately energized and de-energized, thereby driving the motion of the enclosure 12 with results similar to those previously described. Since the magnet typically has a greater mass than the coil, it may be more efficient to vibrate the bottom panel and/or surface upon which the bottom panel rests by moving the magnet instead of moving the coil. The magnet may be in a separate housing in order to permit it to move relative to the coil.

In more detail, the coil 54 remains substantially stationary and the magnet 60 is attached to the driven surface (here, the bottom panel 52). In this embodiment, the magnet 60 moves towards and away from the coil 54 as the coil 54 alternates between polarities. The coil 54 may be secured to the enclosure 12, to one or both of the circuit boards 57, 59 or other elements within the enclosure 12. As the magnet 60 is operably connected to the bottom panel 52, the bottom panel 52 moves as the magnet 60 moves. As discussed above with respect to FIG. 4, this creates sound waves through the movement of air by the bottom panel 52. In this embodiment, the transmission material 56 may be omitted, as the magnet 60 may be directly connected to the bottom panel 52, and therefore there may be a highly efficient transmission of movement between the magnet 60 and bottom panel 52. In these embodiments, the mass of the magnet 60 alone may be sufficient to mechanically vibrate the enclosure 12 and/or surface 24. In other embodiments, the transmission material 56 may be disposed between the magnet 60 and the bottom panel 52. The transmission material 56, as described above, helps to direct the mechanical energy towards the bottom panel 52.

The bottom panel 52 may produce audible low-frequency sound waves (e.g., sound waves of below 1 kilohertz frequency) as well as other audio frequency sounds. This is because as the bottom panel 52 moves in response to the coil 54, it produces sound waves, acting essentially as a diaphragm of a traditional speaker. However, because the bottom panel 52 has a greater mass than a diaphragm of a typical speaker that may be contained within the electronic device, if may move more air and thus produce more (and possibly clearer) audio. That is, because the bottom panel 52 may have a larger surface area than other speakers installed within the electronic device 10, the sound produced by the audio transducer 26 (by causing the bottom panel 52 to move) may be louder than traditional speakers. Also, because the audio transducer 26 utilizes the enclosures 12, 14 to move most of the air, the actual size of the audio transducer 26 may be quite small in comparison to a traditional speaker capable of outputting the same volume of audio. This is beneficial due to the limited space within typical electronic device 10 enclosures. Thus, the audio transducer 26 may save space, while producing a loud sound often not achievable by ordinary speakers within the space constrains of the enclosure(s).

Furthermore, in this embodiment a transmission material 56 may be disposed at least partially around the coil 54. The transmission material 56 helps transmit the mechanical energy produced by the movement of the coil 54 to the enclosure 12. This is because the transmission material 56 directs the energy towards the bottom panel 52 and decreases losses in energy from the transfer. In some embodiments the transmission material 56 may also act to amplify the sound waves produced, increasing the overall volume and sound output by the audio transducer 26.

The transmission material 56 in some embodiments may be an audio gel, as is known to those of ordinary skill in the art. In other embodiments, the transmission material 56 may be a foamed or reticulated material, or a dense flexible material capable of efficiently transmitting vibration from either the coil or magnet to another surface. In still other embodiments the transmission material 56 may be omitted, depending on the energy of transmission desired between the audio transducer 26 and the enclosure 12. Furthermore, the transmission material 56 may depend on the type of material used for the enclosures 12, 14. If the material is very responsive to vibration (such as, for example, carbon fiber) then the transmission material 56 may be omitted.

Similarly, particular materials may be selected for the enclosure, or a portion of the enclosure underlying or adjacent the transducer 26, in order to maximize certain responses. For example, a material that efficiently accepts low-frequency waves produced by the transducer, but less efficiently accepts higher-frequency waves, may be selected in order to enhance bass response but dampen mid-level and/or high-frequency response.

Referring now to FIGS. 1A-5, the electronic device 10 may also include one or more feet 22. The feet 22 support the electronic device 10 on a surface 24, for example on a table, counter-top or the like. The feet 22 may be designed to match the sound impedance of the audio transducer 26, the enclosure, or a surface on which the device 10 rests. In the latter case, the surface may be modeled as an infinite plane formed from a particular material, such as wood, stone and the like. Alternatively, the surface may be presumed to have certain dimensions, such as those of a typical desk or table (for example, approximately six feet long by three feet wide by four inches thick). Vibrations or movements produced by the audio transducer 26 may be further distributed to the surface 24 through the impedance-matched feet. Accordingly, properly-configured feet 22 may increase the energy transfer between the audio transducer 26 and the surface 24. Additionally, the surface 24 may be of significantly greater mass than the audio transducer 26 or enclosure, and thus may produce significantly louder sound than that resulting from moving the enclosure alone. The feet 22 may be placed at various locations on the bottom enclosure 12 to enhance the sound transmission to the table or other surface. The exact placement of the feet may be determined by appropriately modeling the audio transducer, its size and location within the enclosure, the material of the enclosure, a presumed material for the surface, and so on. Essentially, the maximum and/or minimum excitation of the enclosure due to the operation of the audio transducer may be determined and used to model the dimensions, placement and material of the feet 22. In some embodiments, one or feet 22 may be placed on an exterior of the enclosure directly beneath the location of the transducer within the enclosure. The feet may be made from a variety of materials, including rubber, silicone and any other desired material.

Referring back to FIGS. 1A and 1B, the electronic device 10 may also include dampening elements placed within the enclosures 12, 14. For example, due to the mechanical energy produced by the audio transducer 26 portions of the enclosures 12, 14 may move and/or vibrate. In some embodiments it may be desirable to reduce the vibrations of the enclosure 12, 14 near the keyboard 18, mouse pad 50, hand rests or the like. Similarly, some of the internal elements, such as the hard drive, circuit boards 57, 59 or the like, may be sensitive to vibration. To reduce the vibration near certain areas of the electronic device 10, vibration absorbing materials, such as rubber, foam or other dampening materials may be installed around each element. Active vibration dampening may also be used. Likewise, the transducer may be physically separated from vibration-sensitive components. Further, the enclosure and/or other portion of the electronic device 10 may be structurally designed to reduce vibrations acting on such internal components. For example, a non-homogeneous matrix may transmit less vibration or sound than one having a particular resonant frequency. Furthermore, in some embodiments portions of the audio transducer 26 may be surrounded by dampening material. For example, the upper portion of the audio transducer 26 (e.g. the top portion of the bracket 62) may be covered in silicone, rubber or the like. This may direct or reflect more of the mechanical energy towards the bottom panel 58, as well as help to prevent the top panel 28, circuit boards 57, 59 or any other elements from vibrating or at least reduces the vibration felt by these elements.

It should be appreciated that the output of the audio transducer may be affected by any number of factors. Such factors include, but are not limited to, the shape and configuration of the transducer, the physical dimensions of the space within the enclosure or device housing, the material chosen to construct the housing, the surface upon which the electronic device rests, the mass of the gel used in the transducer, and the like. Accordingly, the audio transducer 26 may produce non-linear distortion across at least some of its output frequency. At least some portion of this distortion may be negated or reduced by selectively choosing the materials used to form the enclosure/housing and/or the bracket, as well as other portions of the audio transducer. Certain materials may react to the acoustic energy produced by the transducer in such a manner as to minimize distortion, at least at certain frequencies.

Embodiments may employ digital signal processing (DSP) to reduce or eliminate such non-linear response. Insofar as the characteristics, materials and the like of the electronic device 10 and audio transducer 26 are known, the output of the system may be determined at any given frequency. This output may be compared to a desired (e.g., distortionless) waveform and digitally processed to match such a waveform. In this manner, the non-linear distortion of the system may be reduced or even removed. Essentially, the waveform may be "pre-distorted" to account for the non-linear response. This may not only minimize audible distortion but also blend the output of the gel speaker (e.g., transducer) with other speakers that may be part of an audio system so that the outputted audio is relatively seamless and individual speakers cannot be readily distinguished.

The DSP used to achieve such an output may be preprogrammed based on either sampled outputs at different frequencies or created through a mathematical model, given that general system parameters are known. It should be appreciated that either mathematical modeling or preprogramming based on sampled output may take into account certain factors outside the system, such as a model of a surface on which the electronic device may rest and which may be vibrated by the transducer within the device.

In some embodiments, multiple equalization/DSP profiles may be preprogrammed and available to the embodiment. As the audio transducer and any other speakers operate, the electronic device 10 may select one of the DSP profiles based on either user input or feedback from sensors associated with the device, as described below. Thus, the embodiment may dynamically adjust the DSP profile to account for the operating environment.

In some embodiments, one or more sensors may be placed within, adjacent or electrically connected to the device 10 in order to obtain feedback that may be used to modify the output of the acoustic transducer 26 in order to compensate for the aforementioned non-linear distortion. For example, a microphone may be used to sample the output audio and provide feedback to a DSP chip or a processor executing DSP routines. Since the desired output (e.g., a distortion-free output) is known, the sampled output may be compared to the desired output to determine the nature and extent of variance (e.g., distortion). The embodiment may then apply appropriate signal processing to the waveform in order to account for the variance. Sensors other than a microphone may be used as well. For example, since the enclosure of the device 10 is moving, an accelerometer may measure the device motion and use it to approximate the frequency of vibration. In a wall-mounted embodiment, a gyroscope may be used to measure displacement as well. Sensors measuring acoustic energy may likewise be used. Further, such sensors may determine a position or orientation of the electronic device 10 and, based on the position/orientation, may select a DSP profile to be applied to modify the output of the transducer 26. As one example, a gyroscope or accelerometer may determine that the device is in an orientation that might correspond to hanging on a wall, such as when a tablet device is placed upright. A particular DSP profile may thus be used to enhance the audio by processing the transducer output, thereby varying the way in which the transducer vibrates not only the enclosure but any nearby objects or surfaces. It should be appreciated that the DSP profile may also modify the output of any other speakers or audio devices within the system as well. As another example, a proximity sensor may detect an object nearby the electronic device 10, thereby triggering the application of a different DSP profile.

The audio transducer 26 may be combined with traditional speakers or additional audio transducers to produce a variety of surround sound configurations. FIG. 6 illustrates a stereo surround sound embodiment. In this embodiment, the electronic device 10 may include the speaker 20 along with the audio transducer 26, or rather than the speaker 20 the electronic device may instead include two audio transducers 26. In this configuration, the speaker 20 and the audio transducer 26 (or the two audio transducers 26 in combination) combine to produce a left and right channel surround sound.

Figure 7:
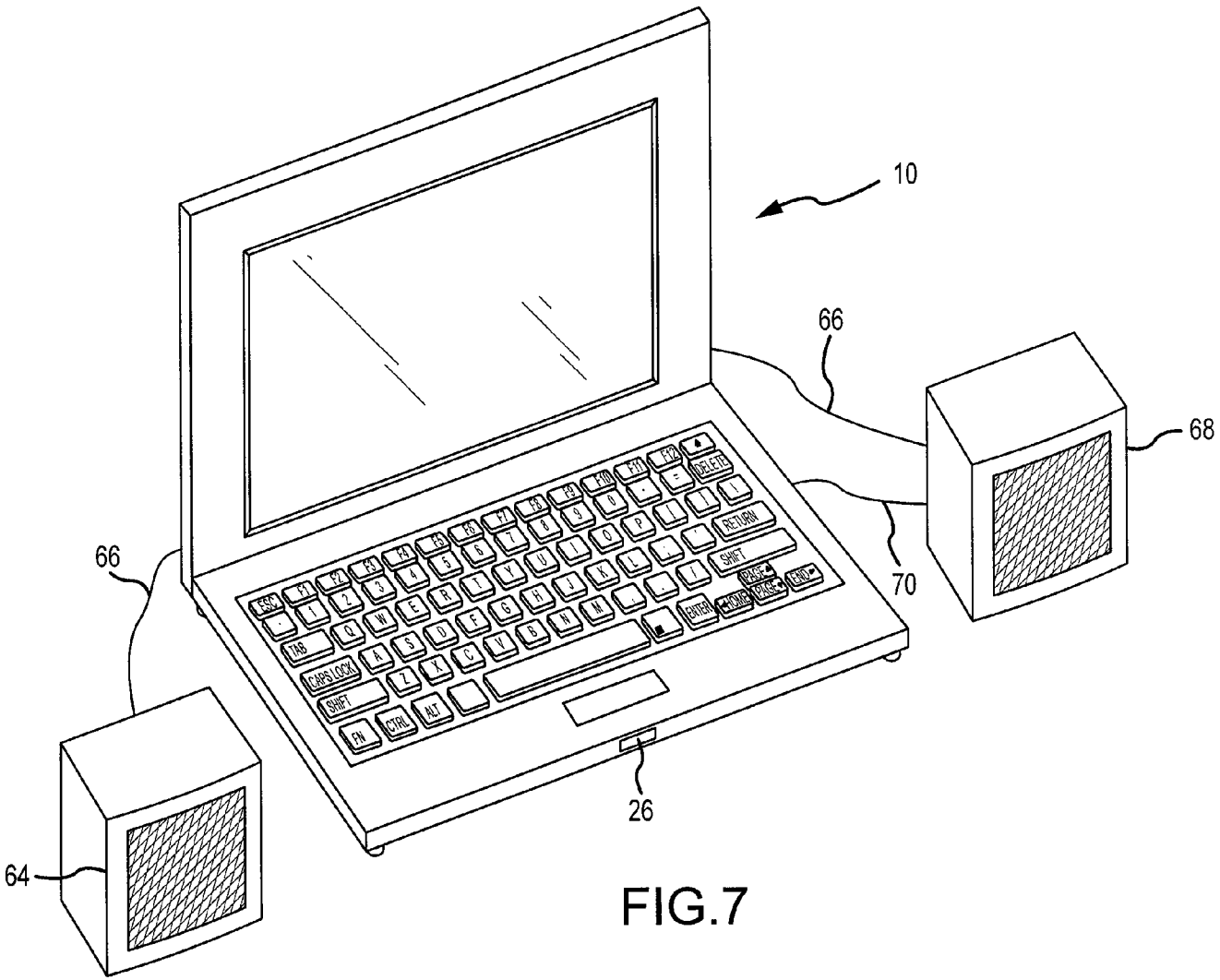
FIG. 7 is a perspective view of the electronic device including attached external speakers, in a 2.1 surround sound audio configuration.

Referring now to FIG. 7, in another embodiment the audio transducer 26 may be combined with external speakers 64, 66. In this embodiment, the external speakers 64, 68 may be connected to each other via electrical cord 66, as well as be connected to the electronic device 10 via input cord 70. In this embodiment, the external speakers 64, 68 may be combined with the audio transducers to provide a 2.1 surround sound configuration. For example, the two external speakers 64, 68 may be either mid or high range while the audio transducer 26 may supply the low range, i.e. act as a subwoofer. It should be noted that although external speakers 64, 68 are illustrated in this embodiment, this same surround sound configuration may be able to be produced via internal speakers (e.g. speaker 20).

Figure 8:
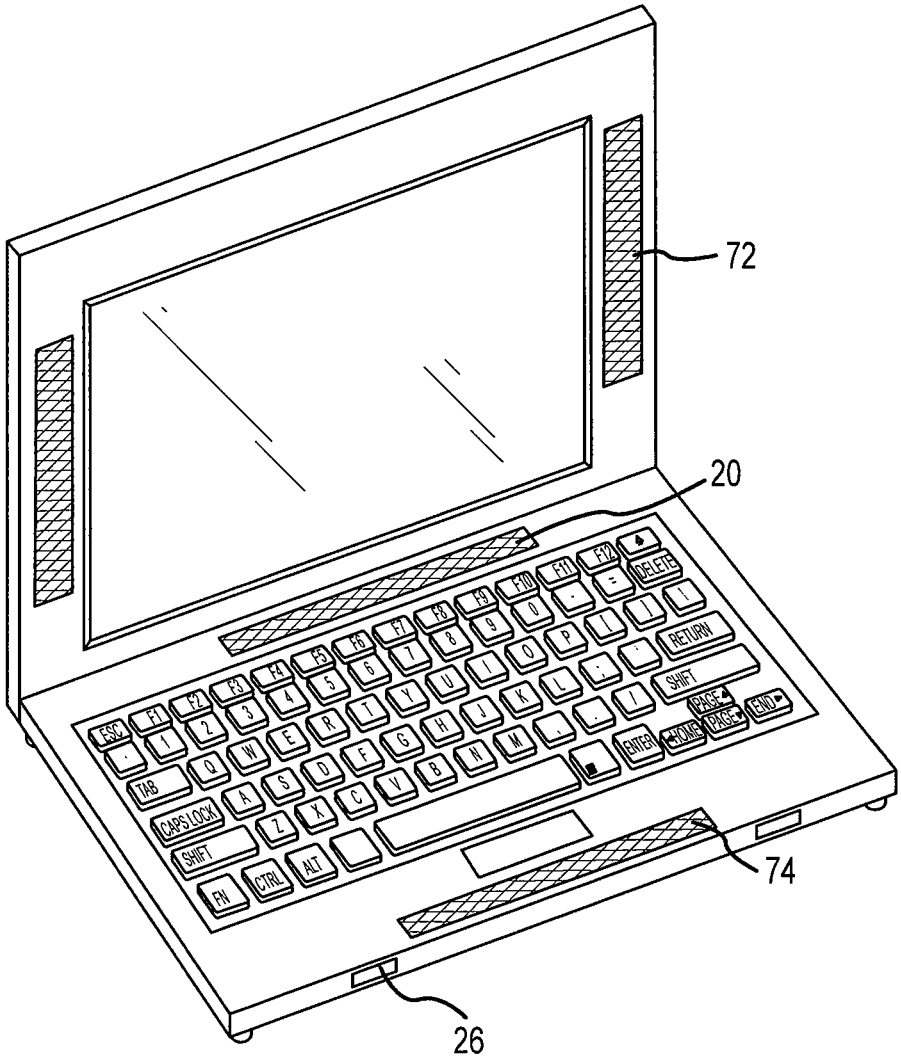
FIG. 8 is a perspective view of the electronic device in a 3.1 and 4.1 surround sound configuration.

Referring now to FIG. 8, in still other embodiments the audio transducers 26 may be combined with multiple other speakers 20, 72, 74 to produce either a 3.1 or 4.1 surround sound configuration. For example, for a 3.1 surround sound configuration two top enclosure speakers 72, in combination with the bottom enclosure speaker 20 and the audio transducer 26, may each cover an audio range. The top enclosure speakers 72 may be high range, the bottom enclosure speaker 20 may be mid range the and audio transducer 26 may be the low range or bass sound. Similarly, to achieve a 4.1 surround sound configuration an additionally bottom enclosure speaker 74 may be added.

Further, the audio transducer may operate in such a fashion that it effectively provides a near full-range response frequency instead of acting like a subwoofer. That is, the transducer 26 may output both low and mid-range frequencies, essentially performing as a "subtweeter." In such embodiments, the speaker may output not only bass range frequencies (e.g., about 20-500 Hz), but also midfrequencies (e.g., about 500-1500 Hz or higher). The audio transducer 26 may be combined with other speakers in an electronic device such as a laptop, tablet or handheld computing device 10. For example, in one embodiment, two tweeters and one woofer may be combined with the audio transducer. The transducer may output the bass channel and, optionally, the middle ranges, while the tweeters handle high frequency outputs. The woofer may output its standard range of frequencies. Through the combination of the woofer and the audio transducer, more decibels per watt may be outputted, especially in bass frequencies.

Although embodiments described herein have generally been discussed with respect to standalone electronic devices (many of which may be portable), it should be appreciated that the teachings of this document may be applied in a variety of other fashions. For example, the audio transducer described herein may be integrated into conventional speakers and operate with the woofers and tweeters of the conventional speaker. In such an embodiment, the audio transducer may vibrate the speaker enclosure or the floor/surface on which the speaker enclosure rests, while the woofers and tweeters vibrate air. The combined motion of the air and the enclosure, as well as the optional surface motion, may combine to create a richer, louder, and/or fuller sound.

Likewise, an audio transducer of the type disclosed herein may be incorporated into a seat or chair as part of a home theater experience. The audio transducer may vibrate not only the chair but the person sitting in the chair under certain circumstances, thereby providing not only audible but also tactile feedback if desired. Further, the motion of the person may serve to displace yet more air and thus create an even louder sound.

As still another example, the audio transducer may be combined with a capacitive or touch-based input so that motions of a user's hands on a device enclosure may act to increase or decrease the output of the audio transducer.

One skilled in the art will understand that the following description has broad application. For example, while embodiments disclosed herein may take the form of speakers for electronic devices, it should be appreciated that the concepts disclosed herein equally apply to sound devices for other applications. Furthermore, while embodiments may be discussed herein with respect to audio transducers, other devices producing sound via mechanical vibration could be used. Also, for the sake of discussion, the embodiments disclosed herein are discussed with respect to speakers, these concepts are equally applicable to other applications, e.g. alarms, vibrating applications and/or video games. Accordingly, the discussion of any embodiment is meant only to be exemplary and is not intended to suggest that the scope of the disclosure, including the claims, is limited to these embodiments.

Although embodiments have been described herein with reference to particular methods of manufacture, shapes, sized and materials of manufacture, it will be understood that there are many variations possible to those skilled in the art. Accordingly, the proper scope of protection is defined by the appended claims.

What is claimed is:

1. An electronic device comprising:

a portable electronic device that can be carried by a user, the portable electronic device having an outer enclosure having a top panel and a bottom panel that surrounds a memory having stored therein a plurality of digital audio equalization profiles to account for a plurality of environments in which the portable electronic device can operate;

an audio transducer that operates to vibrate one of the top and the bottom panel of the outer enclosure in accordance with an audio input signal, wherein the audio transducer comprises a coil and a magnet in communication with the coil; and a processor in electrical communication with the memory and the audio transducer, wherein the processor is to choose, based on a sensor measurement in the portable electronic device that is indicative of an operating environment that is likely to increase non-linear distortion in sound output of the audio transducer, one of the plurality of stored digital profiles and to apply digital signal processing associated with the chosen stored digital profile to pre-distort the audio input signal to the audio transducer to compensate for the non-linear distortion in the sound output of the audio transducer.

2. The electronic device of claim 1, wherein the enclosure is substantially waterproof.

3. The electronic device of claim 1, further comprising at least one speaker; wherein the speaker outputs a first frequency range; and the audio transducer outputs a second frequency range that is below the first frequency range.

4. The electronic device of claim wherein the magnet is substantially prevented from vibrating.

5. The electronic device of claim 4, wherein the audio transducer further comprises a transmission material disposed between the coil and the enclosure.

6. The electronic device of claim 1, further comprising at least two feet disposed on a bottom surface of the enclosure.

7. The electronic device of claim 6, wherein the at least two feet are impedance matched to the audio transducer.

8. An electronic device, comprising:

a processor;

an outer enclosure of a portable computing device having an upper panel and a bottom panel operably connected to the upper panel to surround the processor;

a transducer operably connected to the enclosure and electrically connected to the processor, wherein the transducer is to vibrate the bottom or upper panel of the enclosure, thereby producing a transducer audio signal the transducer having a coil, a magnet in communication with the coil and a bracket substantially surrounding the coil and the magnet, wherein the bracket substantially secures the transducer to the bottom panel;

a first speaker electrically connected to the processor and operative to output a speaker audio signal; wherein the processor is to choose from a plurality of stored digital audio equalization profiles that account for a plurality of environments in which the portable electronic device can operate, based on a sensor measurement in the portable electronic device that is indicative of an operating environment that is likely to increase non-linear distortion in sound output of the transducer, the speaker audio signal and the transducer audio signal cooperate to produce a sound while the digital audio equalization profile chosen by the processor is applied to pre-distort the transducer audio signal to account for the non-linear distortion in the sound output of the transducer.

9. The electronic device of claim 8, wherein the magnet is configured to alternate between a first position and a second position.

10. The electronic device of claim 8, further comprising at least two feet operably connected to a bottom surface of the bottom panel, wherein the at least two feet are configured to substantially match the impedance of the transducer.

11. The electronic device of claim 8, wherein the magnet is substantially prevented from moving in the vertical direction.

12. The electronic device of claim 8, wherein the enclosure is substantially air-tight.

13. The electronic device of claim 8, further comprising an external speaker operably connected to the enclosure.

14. A method for outputting a sound from an electronic device, comprising:

performing, in an outer enclosure of a portable electronic device, the following operations:

by a processor of the portable electronic device, determining a first audible portion and a second audible portion of the sound;

measuring at least one characteristic of a current operating environment of the portable electronic device with an accelerometer, a gyroscope or a proximity sensor, thereby producing a sensor measurement that is indicative of an environment that is likely to increase non-linear distortion in the sound;

choosing a digital audio equalization profile, from a plurality of stored digital audio equalization profiles that account for environments in which the portable electronic device can operate based on the sensor measurement;

electrically driving a magnet-coil audio transducer that is directly connected to an outer enclosure of the electronic device to produce a vibration that vibrates the enclosure to produce the first audible portion of the sound, while applying the chosen digital audio equalization profile to an input signal of the audio transducer thereby distorting the vibration that is producing the first audible portion of the sound; and electrically driving a speaker within the enclosure to move all air mass, thereby producing the second audible portion of the sound.

15. The electronic device of claim 1, wherein one of the plurality of environments includes a surface on which the electronic device rests and which is vibrated by the audio transducer.

16. The electronic device of claim 1, wherein the measurement is at least one of an accelerometer measurement of movement of the enclosure, a gyroscope measurement of an orientation of the device, and a proximity sensor measurement to detect a nearby object.

17. The electronic device of claim 16, wherein the measurement is an accelerometer measurement indicative of an operating environment in which the electronic device is uprightly oriented.

18. The electronic device of claim 1, wherein the digital signal processing associated with the chosen stored digital profile is preprogrammed based on one of sampled outputs of an audio transducer at different frequencies and a mathematical model.

* * * * *